US005377171A

United States Patent [19]

Schlup

[11] Patent Number: 5,377,171

[45] Date of Patent: Dec. 27, 1994

[54] TIMEPIECE MOVEMENT INCLUDING TWO OPPOSED ANALOG DISPLAYS

[76] Inventor: Walter Schlup, 13, avenue Leopold-Robert, CH-2300 La Chaux-de-Fonds, Switzerland

[21] Appl. No.: 188,445

[22] Filed: Jan. 26, 1994

[30] Foreign Application Priority Data

Jan. 29, 1993 [CH] Switzerland ..... 00 265/93-9

[51] Int. Cl.[5] ..... G04B 19/02

[52] U.S. Cl. ..... 368/220; 368/223; 368/140

[58] Field of Search ..... 368/139–150, 368/154, 155–168, 220, 223

[56] References Cited

U.S. PATENT DOCUMENTS

| | | | |
|---|---|---|---|
| 1,432,566 | 10/1922 | Metcalf | 368/190 |
| 1,850,184 | 3/1931 | Spainhower | 368/190 |
| 4,370,063 | 1/1983 | Lee | 368/190 |
| 4,720,820 | 1/1988 | Siefert | 368/190 |
| 5,297,112 | 3/1994 | Cohen et al. | 368/190 |

FOREIGN PATENT DOCUMENTS

| | | |
|---|---|---|
| 0511530 | 4/1992 | European Pat. Off. . |
| 7594 | 11/1893 | Switzerland . |
| 46207 | 2/1909 | Switzerland . |
| 3126/68 | 3/1968 | Switzerland . |

*Primary Examiner*—Bernard Roskoski
*Attorney, Agent, or Firm*—McGlew & Tuttle

[57] ABSTRACT

The movement, of the conventional type with barrel (10) and spring balance, includes two time displays with hands, the hands (3m, 3h, 3s) of one of the displays, arranged opposite one of the principal faces (1) of the movement, being driven in rotation in a known manner by a gear train comprising a toothed center wheel (12) fixed onto an arbor (13) with a pinion (11) meshing with the barrel. Opposite the other principal face (2) is found another time display, the hands (5m, 5h) of which are driven by another gear train (35, 36, 37, 38, 39, 40, 41), a toothed wheel (35) of which is fixed onto the arbor (13) of the center wheel (12). This arrangement permits reducing to a minimum the height of the other gear train and to guarantee the same small backlash for the hands of both displays. The barrel spring (10) is wound by an automatic winding arrangement comprising an oscillating mass (7) arranged opposite the other principal face (2) of the movement. A time setting stem (6) capable of occupying a neutral axial position and two drawn-out positions, enables, in cooperation with a transmission mechanism (47–56), correcting the indications of one of the displays in one of the drawn-out positions and the indications of the other display in the other drawn-out position.

12 Claims, 3 Drawing Sheets

TIMEPIECE MOVEMENT INCLUDING TWO OPPOSED ANALOG DISPLAYS

FIELD OF THE INVENTION

The present invention concerns a timepiece movement intended to fit out a reversible watch displaying different time information on each of its two principal faces. It concerns more specifically a movement including two opposed analog displays with hands indicating, for example, the hour in two different time zones, the hands of one of the displays advancing in the opposite sense but in synchronism with those of the other display.

BACKGROUND OF THE INVENTION

Movements for such watches are themselves known. For example, patent CH 57805 described a double face pocket watch which indicates on each of its faces a different time by means of a movement including two opposed displays, the hands of which pivot around an axis passing through the center of the watch. The hands of one of the displays opposite one of the faces of the movement are set in rotation in a known manner by a minutes arbor loosely adjusted in the arbor of the center wheel, also called minutes wheel, while the hands of the other display are driven in the opposite sense by a wheel train coming into mesh with an intermediate pinion fixed opposite the other face of the movement on the same minutes arbor. The presence of the intermediate pinion arranged between the other face of the movement and the hands of the other display increases accordingly the total thickness of the caliber while introducing additional play in the motion of the hands. If that is acceptable in the case of a pocket watch, such an increase in thickness would constitute, on the other hand, an important drawback in the providing of a wrist watch in which the thickness assumes great importance from the design viewpoint. Another disadvantage of such movement comes from the fact that the displays cannot be separably set., but only together and in synchronism.

Another movement with two opposed displays has been exposed in patent application EP 0504623. In this creation, the hands of one of the displays are the hands of a known type display driven in a known manner by a dial train from the minutes arbor. The hands of the other display are set in rotation in the sense opposite to that of the first mentioned hands by a gear train arranged to be flat on the other face of the movement, in a manner to reduce as much as possible the overthickness. The transmission of the rotational movement of a wheel set of the dial train to the wheel sets arranged on the other face is obtained by means of an indented traversing cannon joining the two faces of the movement and cooperating with an exterior control push piece. If this arrangement of the wheel sets enables obtaining a movement of small thickness, on the other hand the length of the gear train introduces still more substantial play than in the preceding case in driving the hands of the other display during the synchronous time setting of the two displays. In order to render such play acceptable, the toothed wheels must exhibit small backlash and thus respond to severe manufacturing standards bringing about a high cost of manufacture. The separate setting of each display is possible in this arrangement, but this thanks to the control push piece, the presence of which complicates the design of the movement as well as that of the watch case.

The two arrangements which have just been described which concern mechanical as well as electronic analog movements thus present substantial drawbacks which the present invention, on the other hand applicable only to mechanical movements with a sprung balance, proposes to overcome.

SUMMARY OF THE INVENTION

In order to attain this objective, the timepiece movement with a spring balance according to the invention, bounded by two opposed substantially planar and parallel principal faces, including two time displays with hands, a spring retaining barrel, a gear train comprising a toothed center wheel fixed to a pinion meshing with said barrel, a toothed third wheel fixed to a pinion meshing with said center wheel and a toothed minutes wheel effecting one revolution per hour, and means for transmitting the energy stored in the spring to the spring balance system and for driving in rotation the hands of one of said displays opposite one of said faces, another gear train having as function the driving in synchronism with said hands, of the hands of the other display opposite the other face, winding means for the barrel spring and time setting means for both displays is especially notable in that said other gear train includes a toothed intermediate wheel which is fixed in rotation to said center wheel.

An advantage of the invention comes from the fact that the gear train driving the hands of the other display includes very few wheel sets and that such are arranged in a manner so as to increase the height of the movement to the least extent possible.

Another advantage results from the fact that the hands of both displays exhibit the same play with wheels of the same quality for both gear trains.

Other characteristics and advantages of the movement according to the present invention will become apparent from the description which is to follow, having regard to the attached drawings and giving, by way of explanation but in no manner limiting, an example of an embodiment of such a movement. On such drawing, the same references refer to analogous elements.

DESCRIPTION OF THE PREFERRED EMBODIMENT

Figure 1:
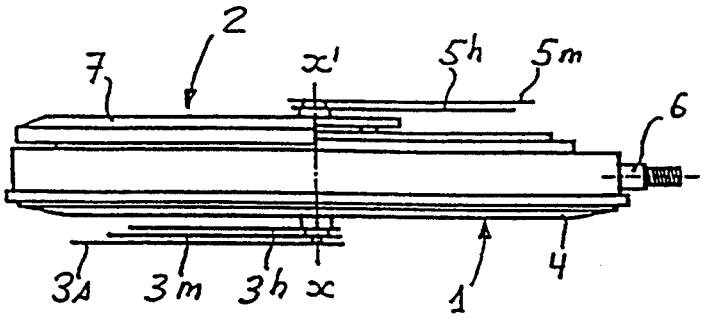
FIG. 1 is a profile view of one embodiment of a movement according to the invention, including a time display by means of hands opposite each of its principal faces, and an oscillating mass for automatic winding.

An embodiment of a mechanical timepiece movement with a spring balance and two time displays according to the invention is shown on FIG. 1. References 1 and 2 designate respectively the two principal faces, substantially planar and parallel to the movement. Opposite face 1, or the first face, is arranged an analog time display or first display constituting the standard display and including hours hand 3h, minutes hand 3m and seconds hand 3s being displaced in front of dial 4. Opposite face 2, or the second face, is located another analog time display, or second display, including hours hand 5h and minutes hand 5m, displaced in synchronism with but in the opposite sense from the previously mentioned hands and enabling the indication of time in any other time zone. In the present embodiment, the hands of both displays pivot around a common axis xx'. A time setting stem 6 with three axial positions enables separate correction of the indications of both displays and rewinding the spring in a manual movement, but in the present case an automatic movement including an oscillating mass 7 is concerned.

Figure 2:
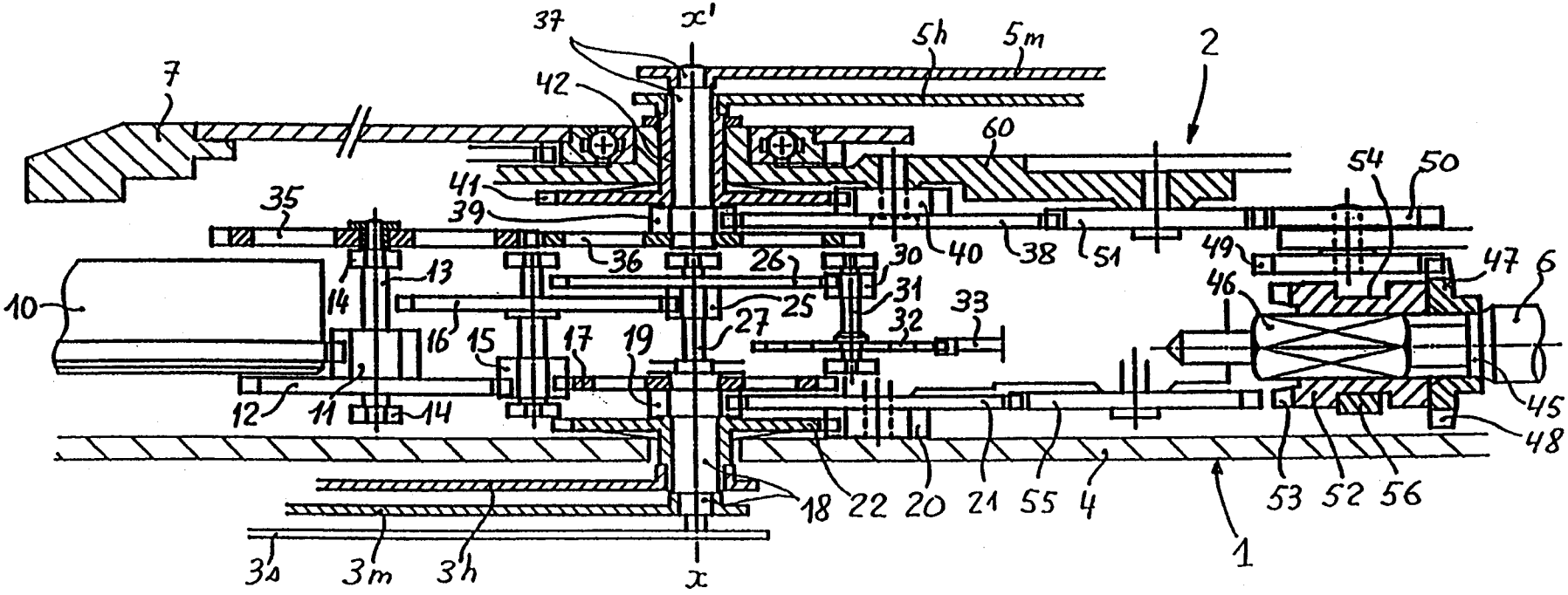
FIG. 2 shows, in a cross-sectional view by a plane passing through the rotational axis of the hands, the principal wheel sets and control elements of the movement.

FIG. 2 shows in a cross-section view the arrangement of the principal elements of the movement. The teeth of the spring barrel or driving means 10 are in mesh with a drive pinion 11 fixed to a toothed center drive wheel 12, the drive pinion 11 and toothed center drive wheel 12 being supported by a center drive arbor 13 pivoting in bearings 14. A first display initial pinion 15 fixed to a third wheel 16 meshes on the one hand with center drive wheel 12 and on the other hand with a toothed first display minutes wheel 17 also called a center wheel effecting one revolution per hour. The minutes wheel drives the minutes hand 3m of the first time display in rotation through a friction cannon 18 including a pinion 19. A pinion 20 fixed onto the toothed dial train wheel 21, which is driven by pinion 19 of the friction cannon, meshes with a toothed hours wheel 22 effecting one revolution in 12 or 24 hours and directly driving in rotation the hours hand 3h. As to the third wheel 16, this is in mesh with a pinion 25 fixed to a toothed seconds wheel 26. Pinion 25 and wheel 26 effect one revolution per minute and they are supported on the arbor 27 on which is fixed to the seconds hand 3s. The seconds wheel 26 meshes with a pinion 30 fixed onto an arbor 31 supporting an escapement wheel 32. Finally, an anchor 33, cooperating with the escapement wheel, transmits the energy stored in the spring of barrel 10 to the spring balance regulating system, not shown.

The wheel sets which have just been described and their kinematic connections form a gear train which is well known from the prior art. It is necessary to mention that all the wheels of such first gear train, in particular the center wheel, but with the exception of the minutes and hours wheels, are under stress, that is to say that they transmit permanently a couple to the following wheel which has as effect to eliminate all backlash between the teeth of two wheel sets in direct mesh.

Hands 5h and 5m of the second display are driven from their side by another gear train. Such second gear train which constitutes the invention as such, is described hereinafter.

On arbor 13 supporting the center wheel 12 is secured a toothed intermediate wheel 35. Wheel 35, fixed in rotation to wheel 12, meshes with a toothed second display minutes wheel 36 which effects one revolution per hour around axis xx'. Wheel 36 is similar to the minutes wheel 17 of the first gear train and it drives in the same manner as such latter the minutes hand 5m of the second display by means of a friction cannon 37 similar to cannon 18. Finally, a toothed dial train wheel 38 meshing with a pinion 39 of cannon 37 drives through pinion 40 an hours wheel 41 supporting the hours hand 5h through a pipe 42.

The restrained number of wheel sets in the second gear train and their arrangement in the same plane have as consequence that such wheel sets occupy a height which is reduced to the minimum. The absence of play in the intermediate wheel 35 on the other hand causes the hands of both displays to show the same small angular backlash.

The correction of the indications of each time display separately is obtained by means of the time setting stem 6 which can occupy three axial positions, and of an appropriate mechanism itself known. To this end, stem 6 includes a cylindrical portion 45 and a portion with a squared-off section 46. On the cylindrical portion there is a pinion which rotates freely having a central squared opening and radial peripheral teeth 48, the teeth coming into mesh with the first toothed wheel of a gear train formed from toothed wheels 49, 50 and 51, the last wheel 51 meshing with the dial train wheel 38. The squared-off portion 46 of stem 6, from its side, supports and drives in rotation a pinion 52 sliding longitudinally on the stem 6 and including axial teeth 53 and a circular groove 54. A toothed wheel 55 meshes with the dial train wheel 21 and, as determined by the axial position of pinion 52, with the teeth 53 of this latter. Finally, in groove 54, there is arranged the end of a lever 56 intended to displace pinion 52 axially dependent upon the axial position of stem 6.

Figure 3:
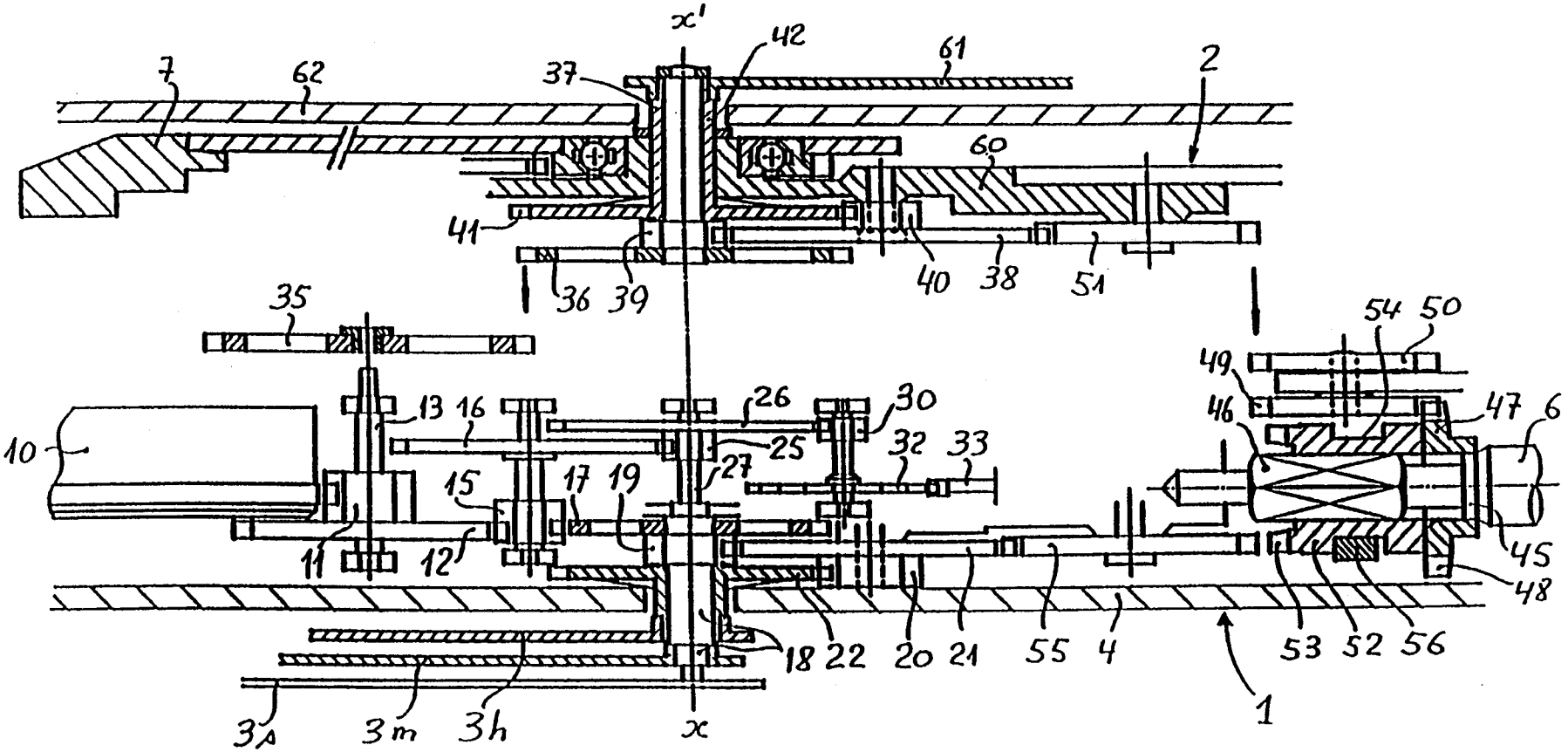
FIG. 3 shows the two principal portions of the movement separated from one another.

On FIGS. 2 and 3, the time setting stem 6 is shown in its pushed-in or neutral position in which its rotation does not bring about any modification of the displays. Effectively, pinion 47 is not driven by the portion of the stem having a squared -off section 46, while pinion 52 although rotating does not mesh with wheel 55. In the first drawn-out position of stem 6, portion 46 comes just flush with pinion 47 while lever 56 displaces pinion 52 in a manner such that its teeth 53 come into mesh with those of wheel 55. A rotation of stem 6 then drives wheel 55 and hands 3m and 3h of the first display without having an effect on those of the second display. In displacing stem 6 into its second drawn-out position, the squared-off section 46 penetrates into the squared opening of pinion 47 while lever 56 displaces pinion 52 in a manner to remove teeth 53 from wheel 55. In such conditions, rotation of stem 6 has as effect the driving of pinion 47 and thus hands 5m and 5h of the second display without displacing those of the first display. It would also be possible to arrange the mechanism so that the time setting stem 6 corrects one of the displays in one of the drawn-out positions and both displays in synchronism in the other drawn-out position. It is well understood, if the movement were to include a calendar arrangement, stem 6 would have to be able to occupy three drawn-out positions, the first for setting the calendar to the correct date, the second and third positions corresponding then respectively to the first and second positions which have just been described.

A bridge 60 supports the oscillating mass 7 of known type. Arranged between the principal face 2 and hands 5m and 5h, it pivots around axis xx'. A central hole formed in such mass gives passage to the elements driving the hands. A wheel train, not shown, couples mass 7 to the barrel 10 and assures furthermore, in a known manner, winding of the spring. In order to facilitate assembly of the movement, the elements referenced 36 to 41 and 51 are also arranged on bridge 60. It is then sufficient to remove bridge 60, as is shown on FIG. 3, in order to give access to the elements previously cited.

It is self understood that the timepiece movement which has just been described may undergo still further modifications than those which have already been mentioned and appear under other variants evident to the person skilled in the art without departing from the framework of the present invention. In particular, the seconds hand 3s could pivot around an axis different from axis xx' and appear for example in the form of a small hand arranged at 6 o'clock. In place of hands 5m and 5h, the second display could include a single hand 61 shown on FIG. 3, effecting one revolution per 24 hours and indicating the time zones on a dial 62. As is well understood, the movement could be of the manual winding type, and in such case hands 5m, 5h, 61 could also pivot around an axis other than axis xx'.

What I claim is:

1. A timepiece movement with a spring balance, bounded by two opposed substantially planar and parallel principal faces, including two time displays with hands, a spring retaining barrell, a gear train comprising a toothed center wheel fixed to a pinion meshing with said barrell, a toothed third wheel fixed to a pinion meshing with said center wheel and a toothed minutes wheel effecting one revolution per hour, and means for transmitting the energy stored in the spring to the spring balance system and for driving in rotation the hands of one of said displays opposite one of said faces, another gear train having as function the driving in synchronism with said hands, of the hands of the other display opposite the other face, winding means for the barrel spring and time setting means for said displays, said other gear train including a toothed intermediate wheel which is fixed in rotation to said center wheel.

2. A movement as set forth in claim 1, wherein the hands of each display pivot in the opposite sense to the hands of the other display around a common axis arranged perpendicularly to said faces.

3. A movement as set forth in claim 1 or in claim 2, said other display comprising a single hand effecting one revolution per 24 hours in order to indicate the hour in different time zones.

4. A movement as set forth in claim 1, wherein said winding means form an automatic winding arrangement including an oscillating mass arranged between the other principal face and the hands of the other display, which exhibits an opening around its rotation axis for the passage of elements supporting at least one hand of the other display, and a wheel train for transmitting the motions of said mass to the barrel spring in order to wind it.

5. A movement as set forth in claim 1, wherein said other gear train comprises said toothed intermediate wheel, a toothed minutes wheel meshing with said intermediate wheel, a cannon fixed in rotation to said minutes wheel and supporting the minutes hand, a toothed dial train wheel fixed to a pinion and meshing with a pinion fixed onto said cannon, and a toothed hours wheel supporting the hours hand through a pipe and meshing with the pinion of the dial train.

6. A movement as set forth in claims 4 and 5, furthermore including a bridge supporting said oscillating mass, said minutes wheel, said cannon, said dial train wheel and said hours wheel of said other gear train.

7. A movement as set forth in claim 1, said time setting means comprising a time setting stem having three axial positions, the first position being neutral, and a mechanism having as function the transmission of the rotation of the stem, when the latter is in the second position, to a toothed wheel of said gear train for time setting the display without modifying the indication of the other display, and, when the stem is in the third position, to a toothed wheel of said other gear train for time setting the other display without modifying the indication of the first-named display.

8. A timepiece movement comprising:

driving means for providing rotational force, said driving means including teeth;

a drive pinion meshing with said teeth of said driving means;

a center drive arbor fixed to said drive pinion and rotating with said drive pinion;

a center drive wheel fixed to said drive pinion and rotating with said drive pinion;

a first display initial pinion meshing with said center drive wheel;

a first display minutes wheel meshing with said first display initial pinion;

a first minute hand connected to said first display minutes wheel;

a first face cooperating with said first minute hand to create a first time display;

a second minute hand;

a second face cooperating with said second minute hand to create a second time display;

second display gear means for rotating said second minute hand in a direction opposite to a direction of rotation of said first minute hand, said second display gear means including an intermediate wheel fixed to said drive pinion and rotating with said drive pinion.

9. A movement in accordance with claim 8, wherein:

said first and second faces are positioned on substantially opposite sides of said driving means.

10. A movement in accordance with claim 8, wherein:

said first display minutes wheel and said first minute hand rotate in substantially a same direction and speed.

11. A movement in accordance with claim 8, wherein:

said second display gear means includes a second display minutes wheel meshing with said intermediate wheel, said second display minutes wheel and said second minute hand rotate in substantially a same direction and speed.

12. A movement in accordance with claim 8, further comprising:

escapement means for controlling said drive means through a gear train branching off from said first display initial pinion.

* * * * *